US008616849B2

(12) United States Patent
Menheere et al.

(10) Patent No.: US 8,616,849 B2
(45) Date of Patent: Dec. 31, 2013

(54) FAN BLADE PLATFORM

(75) Inventors: David H. Menheere, Geogetown (CA); Andreas Elfetheriou, Woodbridge (CA); Philip Ridyard, Mississauga (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 1239 days.

(21) Appl. No.: 12/372,758

(22) Filed: Feb. 18, 2009

(65) Prior Publication Data

US 2010/0209251 A1 Aug. 19, 2010

(51) Int. Cl.
*B63H 1/16* (2006.01)
*B63H 1/20* (2006.01)

(52) U.S. Cl.
USPC ..... 416/193 A; 416/206; 416/220 R; 416/221

(58) Field of Classification Search
USPC ..... 416/193 A, 204 A, 220 R, 206, 221
See application file for complete search history.

(56) References Cited

U.S. PATENT DOCUMENTS

| | | | | |
|---|---|---|---|---|
| 3,294,364 | A | 12/1966 | Stanley | |
| 3,712,757 | A | 1/1973 | Goodwin | |
| 4,621,979 | A | 11/1986 | Zipps et al. | |
| 4,655,687 | A | 4/1987 | Atkinson | |
| 5,049,035 | A | 9/1991 | Marlin | |
| 5,160,243 | A | 11/1992 | Herzner et al. | |
| 5,161,949 | A | 11/1992 | Brioude et al. | |
| 5,240,375 | A | 8/1993 | Wayte | |
| 5,368,444 | A | 11/1994 | Anderson | |
| 5,791,877 | A | 8/1998 | Stenneler | |
| 6,217,283 | B1 | 4/2001 | Ravenhall et al. | |
| 6,471,474 | B1 | 10/2002 | Mielke et al. | |
| 6,514,045 | B1 | 2/2003 | Barton et al. | |
| 7,153,099 | B2 | 12/2006 | Queriault et al. | |
| 2004/0013528 | A1 | 1/2004 | Leathart | |
| 2004/0067137 | A1 * | 4/2004 | Moroso | 416/221 |
| 2004/0126240 | A1 | 7/2004 | Bassot et al. | |
| 2004/0258528 | A1 * | 12/2004 | Goga et al. | 416/193 A |
| 2008/0232969 | A1 | 9/2008 | Brault et al. | |

* cited by examiner

*Primary Examiner* — Nitin Parekh
(74) *Attorney, Agent, or Firm* — Norton Rose Fulbright LLP

(57) ABSTRACT

A fan blade platform assembly comprises a plate insert shaped and dimensioned to span a gap formed between the opposed facing platforms of adjacent fan blades of a turbo fan engine. The plate insert can be retained in engagement under arresting shoulders provided on the adjacent fan blades by a spring force exerted by a spring insert held captive and in contact between the plate insert and an outer surface of the fan hub.

5 Claims, 5 Drawing Sheets

FAN BLADE PLATFORM

TECHNICAL FIELD

The present disclosure relates to a fan blade platform for interconnection between adjacent fan blades secured to a rotor fan hub of a turbo fan engine.

BACKGROUND ART

Attempts have been made in the design of fan blade platforms, which are usually integrally formed with the fan blades, to reduce the size of the platform formations and consequently the weight of the fan blades. Fan blades are heavy and are expensive to produce due to the use of expensive materials, such as titanium 6-4. The current practice is to extend the fan blade platform from one blade to the next forming the gas path with mating fan blade platforms.

SUMMARY

According to a broad general aspect, there is provided a fan blade platform assembly comprising a rotor fan hub, a plurality of fan blades and a plurality of plate inserts, the plate inserts shaped and dimensioned to span a gap formed between platforms of adjacent fan blades of a turbo fan engine, the plates and platforms providing a gaspath surface, the plate inserts retainingly engaged under arresting shoulders of said adjacent fan blades by spring forces exerted by a plurality of spring inserts held captive and in contact between said plate inserts and an outer surface of the rotor fan hub.

According to a further general aspect, there is provided a method of attaching an inner platform to a fan assembly, comprising inserting a plate in a gap between spaced-apart facing platforms of two adjacent fan blades extending from a fan hub, the plate filling the gap between the spaced-apart facing platforms and cooperating with the platforms to form a smooth gas path surface for incoming air, and holding the plate in place in the gap by urging the same radially outwardly against an arresting surface provided on the adjacent fan blades.

BRIEF DESCRIPTION OF DRAWINGS

Reference is now made to the accompanying figures, in which.

DETAILED DESCRIPTION

Figure 1:
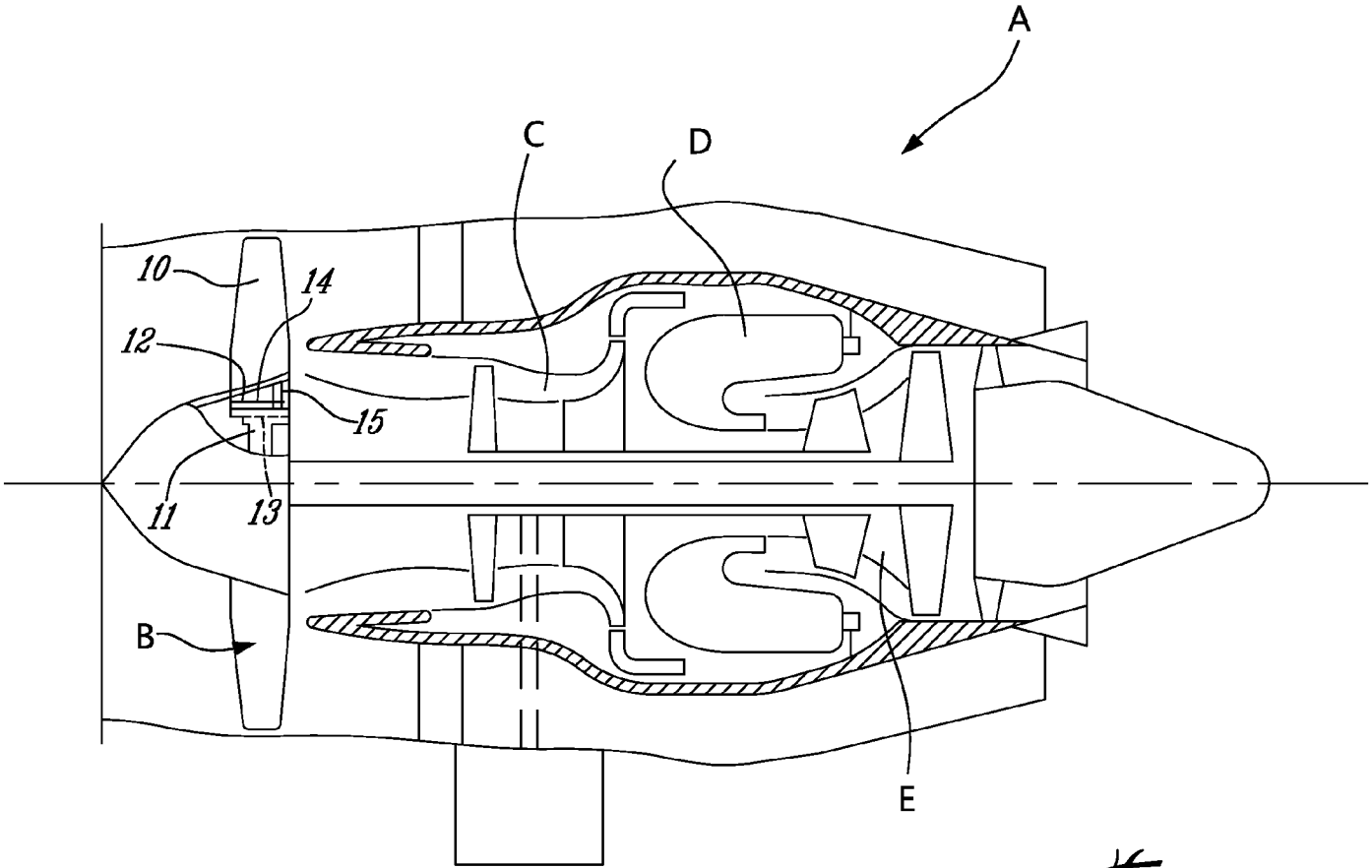
FIG. 1 is schematic cross sectional view of gas turbine engine partly fragmented to show the location of the fan blade anti-fretting and blade platform insert of one embodiment of the present design.

FIG. 1 illustrates a turbo fan gas turbine engine A of a type preferably provided for use in subsonic flight, and generally comprising in serial flow communication a fan section B through which ambient air is propelled, a multistage compressor C for pressurizing the air, a combustor D in which the compressed air is mixed with fuel and ignited for generating an annular stream of hot combustion gases, and a turbine section E for extracting energy from the combustion gases.

As herein shown, the fan blade section B is comprised of a plurality of fan blades 10 secured about a rotor fan hub 11. Each fan blade 10 has a root section 12 depending from the undersurface of a fan blade platform 31 (see FIGS. 2, 3 and 4). The root section 12 of each blade 10 is retained in a root slot 13 formed in the periphery of the rotor fan hub 11. As will be seen hereinafter, the size of the fan blade platforms 31 can be reduced and the space or resulting axial gap between each pair of adjacent reduced blade platforms 31 can be filled by a blade platform insert 14 including an integrated or separate anti-fretting support structure 15 adapted to apply a pulling force on the root section 12 of adjacent fan blades 10 to prevent rocking of the root sections 12 in the root slots 13 at low rotational speeds of the fan blades, such as when turned by wind action with the engine off.

Figure 2:
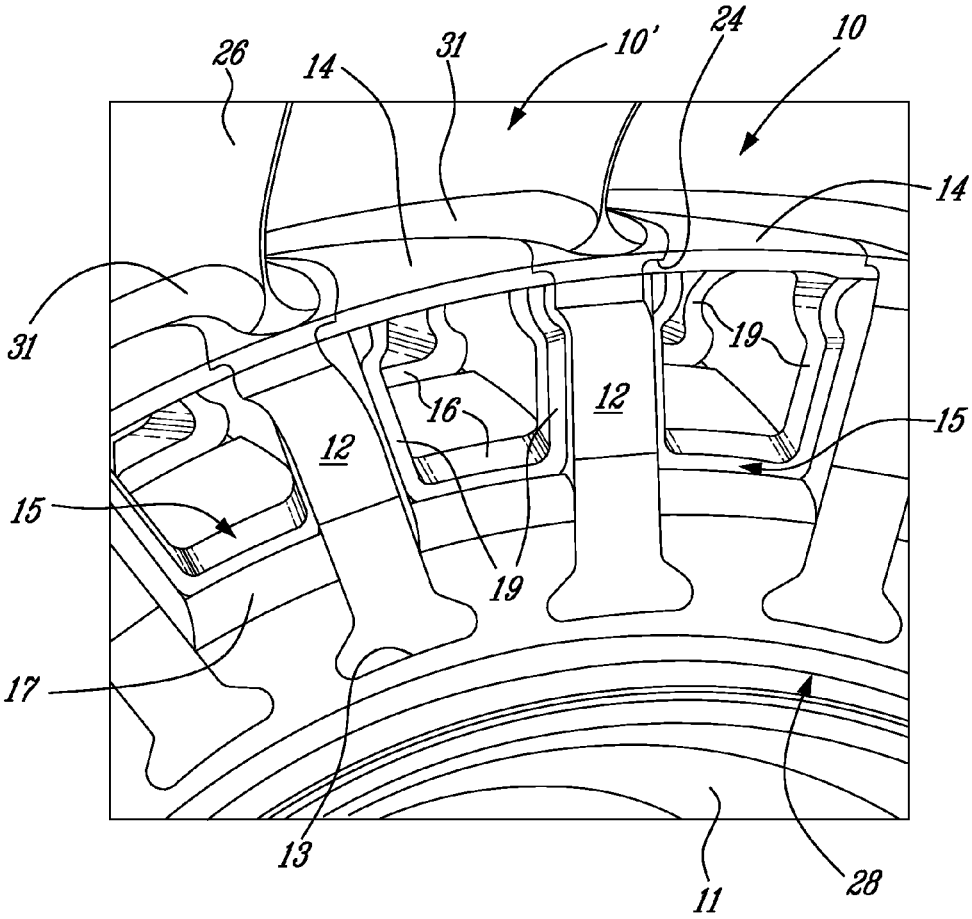
FIG. 2 is a fragmented front perspective view showing details of the fan blade connection portion to the fan hub.
Figure 3:
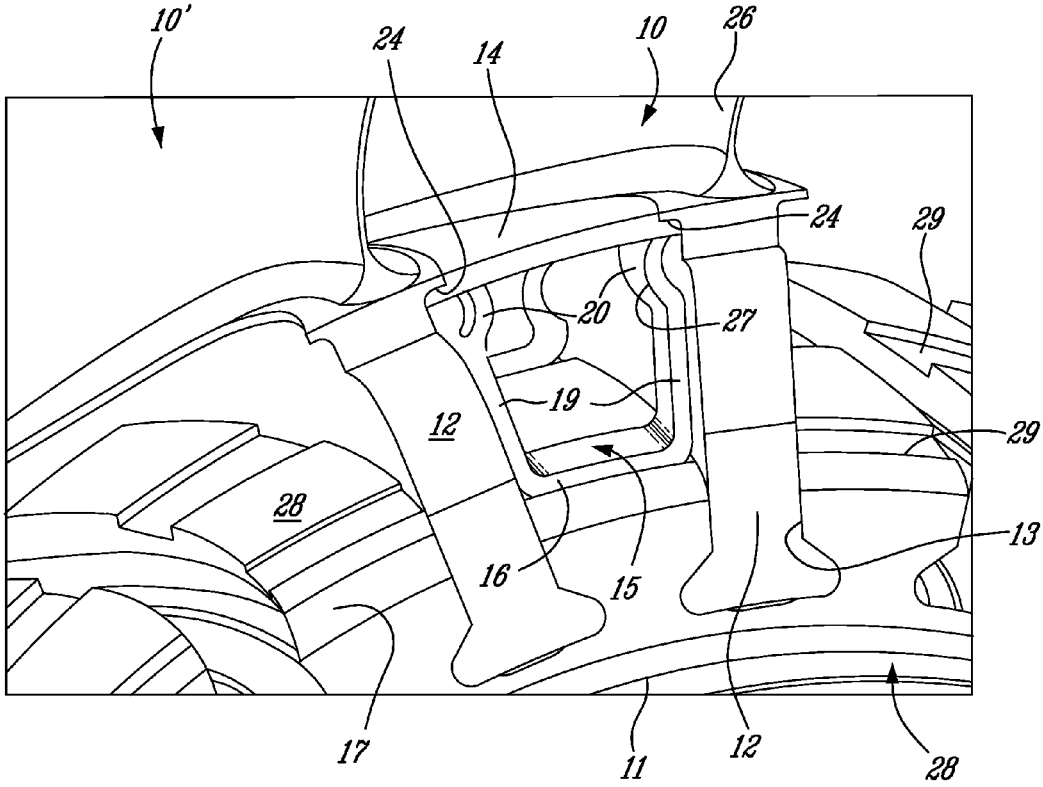
FIG. 3 is an enlarged view of a portion of FIG. 2.
Figure 4:
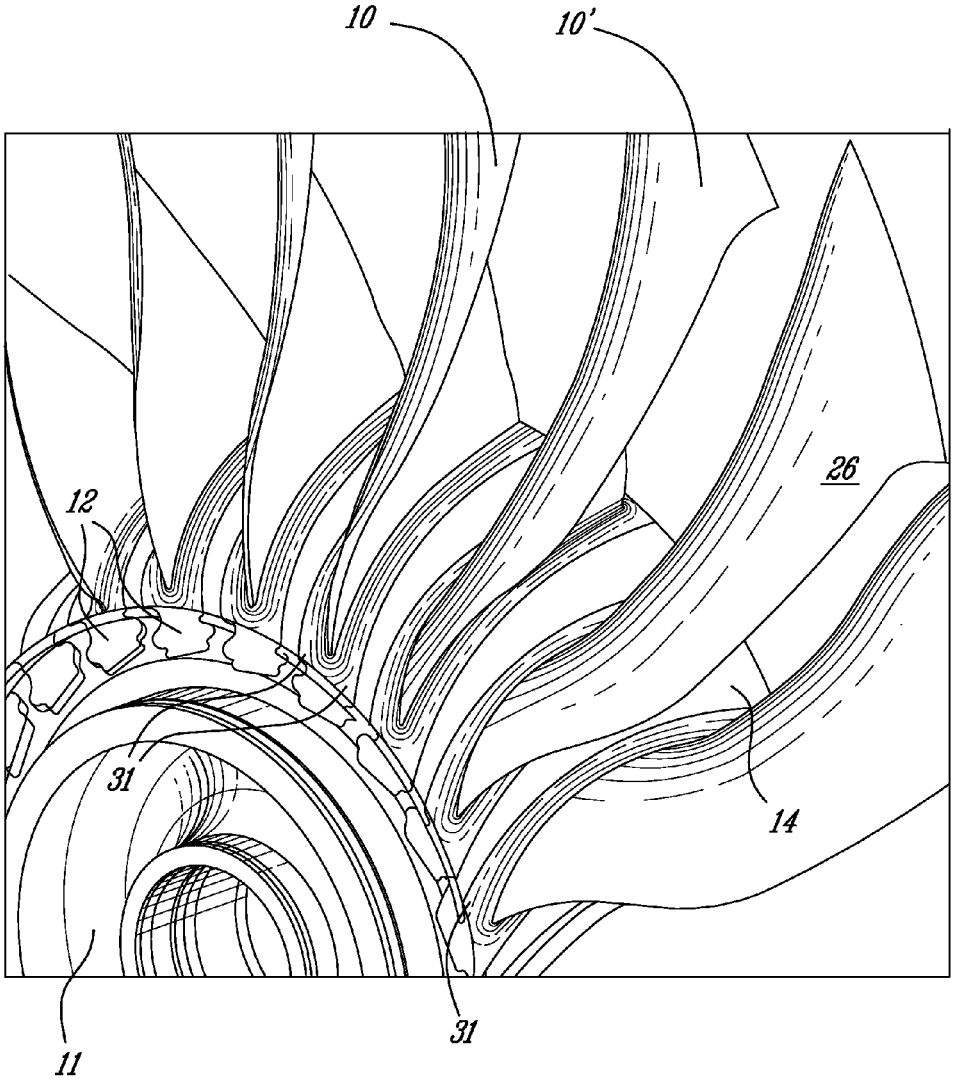
FIG. 4 is a rear perspective view or the fan hub illustrating the anti-fretting blade platform inserts interposed between the fan blades.
Figure 5:
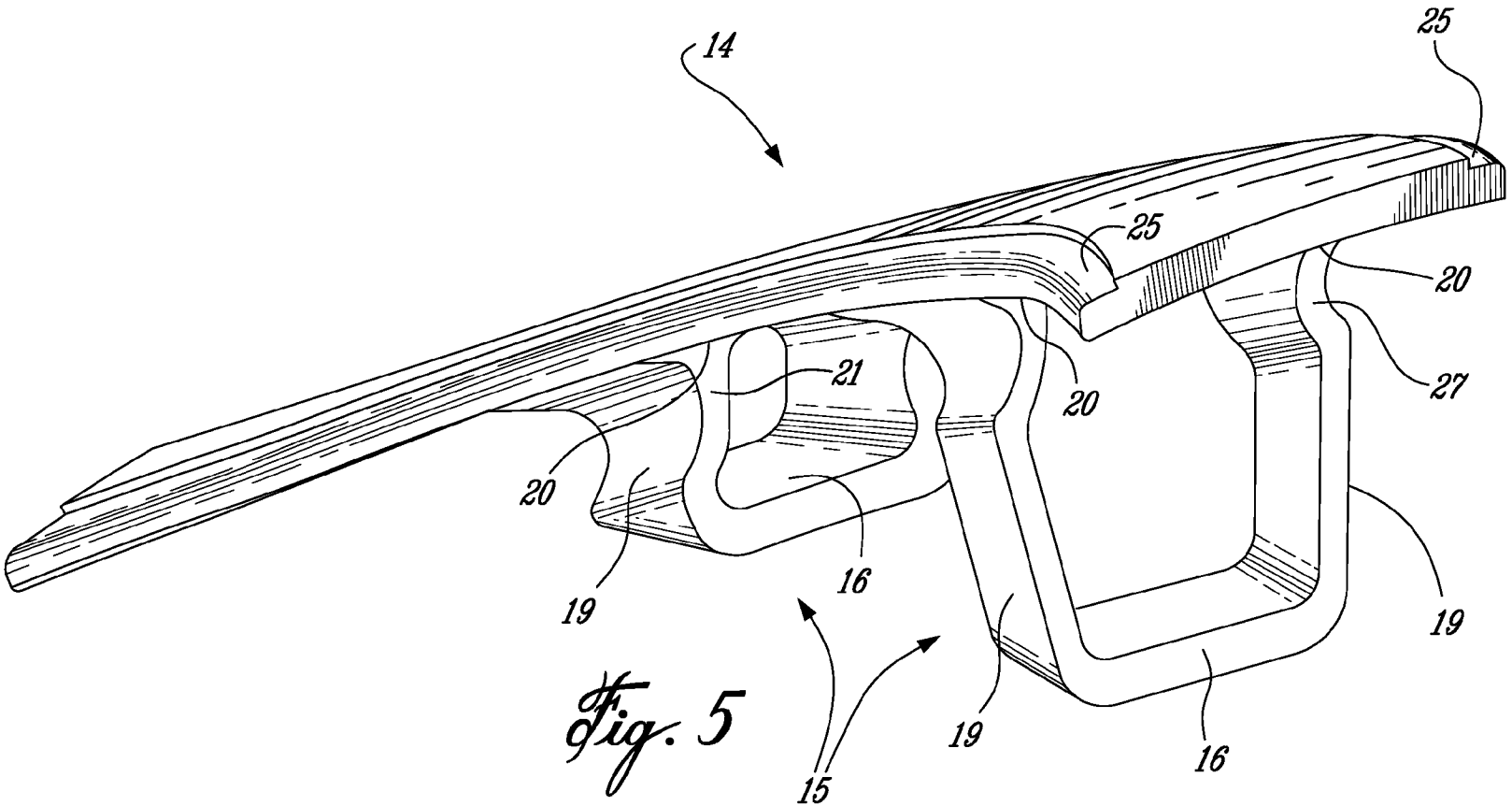
FIG. 5 is an isometric view of one anti-fretting blade platform insert.

With reference now to FIGS. 2, 3 and 5, the fan blade anti-fretting structure 15 is herein shown and comprises a pair of U-shaped legs formed of composite spring material, such as carbon fiber epoxy or other material capable of having a memory, whereby to retain its shape when flexed. The spring-loaded legs of the anti-fretting structure 15 can be interconnected by the blade platform insert 14 (see FIG. 5). The anti-fretting legs each define a bottom wall portion 16 which is configured to abut an outer or rim surface portion 17 of the rotor fan hub 11 between adjacent fan blades 10 and 10', as shown. The anti-fretting legs also each define opposed side wall portions 19 formed integral with the bottom wall portion 16. Each U-shaped leg has outer flat abutment surfaces spring-loaded against the opposed inwardly facing sides of the root sections 12 of adjacent fan blades outside of the associated slots 13. The side wall portions 19 are dimensioned to abut at an upper end 20 thereof against a connection of opposed fan blades. As herein shown, the connection can be constituted by the blade platform insert 14 spanning the gap between adjacent reduced blade platforms. The anti-fretting structure 15 is dimensioned and configured to push the platform insert 14 against and undersurface of the blade platforms 31 to thereby exert a pulling force on the root portions 12 of the adjacent fan blades 10 and 10' to prevent rocking of the root portions in their respective root slots 13. Because the root portions are loosely fitted within the root slots 13 as they are axially slid therein, this radial pulling force exerts a constant restraining force on the root portions within their respective root slots and prevent rocking of the fan blades at low rotational speeds such as cause by wind milling when the engine is off.

As mentioned herein above, the connection to the adjacent fan blades can be accomplished by the platform insert 14 which is held in the gap between adjacent fan blade platforms 31 by arresting formations 24 formed integral with the blades 10 in the reduced blade platform area at the transition between the airfoil section 26 of the fan blade 10 and the root portion 12. The anti-fretting or biasing structure 15 is dimensioned such as to push the platform insert 14 against the arresting formations 24 in contact with the opposed fan blades.

As herein shown the opposed side wall portions 19 of the U-shaped legs have an inner curve spring action formation 27 in a top portion thereof. The bottom wall portion 16 as well as the side wall portions 19 also have flat outer side abutment surfaces and are shaped for close fit against the inner side walls of the root portion 12 of the fan blades and the rim 28 of the rotor fan hub 11. As shown in FIG. 3, the rotor fan hub 11 is provided with a pair of outwardly radially facing grooves 29 there around and the insert bottom wall portion 16 of each leg is provided in snap fit retention therein.

It is also pointed out that the spring action formation 27 may also be an engaging formation integrally formed with the side wall portions 19 for clapping engagement with an attaching formation (not shown) formed in the opposed side wall of the fan blade root portion 12 whereby to snap fit engage thereon. These biasing legs are installed from the downstream side of the rotor fan hub 11 and forcingly positioned between the hub peripheral wall or rim 28 and the blade platforms 31 whereby to be retained in tension to bias the platform insert 14 radially outwardly against the arresting formations 24 provided on the undersurface the reduced blade platforms 31.

The inner fan blade platform insert 14 can be formed as a flat metal plate which is shaped and dimensioned to span the gap formed between adjacent fan blade platforms 31 of the turbo fan engine A. The platform metal plate can be formed of the same material as the fan blades, usually titanium. The U-shaped legs of the anti-fretting 15 can be integrally joined to the underside of the platform insert 14. As above described, it is retained engaged under arresting formations 24 which can be provided in the form of lips or shoulders extending outwardly from opposed sides of the blade reduced size platforms 31. These lip formations 24 have a flat under face shaped to receive opposed edge face portion of the platform insert 14. As shown in FIG. 5, the platform insert 14 is provided along opposed sides thereof with shoulders 25 for engagement with the lip formations 24 on the undersurface of the blade platforms 31. The top surface of the platform insert 14 is leveled with the blade platform top surface when the shoulders 25 are pushed against the lip formations 24, thereby providing a smooth composite platform surface between the blades. The platform inserts 14 can be provided with a slight arcuate profile as herein shown to cooperate with the reduced blade platforms 31 in forming a smooth inner boundary flow path for the incoming air.

Accordingly, the platform design as herein describe result in a light weight platform which fill the gap between the fan blades reducing the size of the fan blade platform usually formed integrally with the fan blades and consequently reducing the weight and cost of the fan blades. This also results in less containment/weight needed in the fan case. Further, the anti-fretting structures 15 cooperate with the platform inserts 14 to provide a radially outward biasing force between the rim 28 of the fan hub 11 and the blade platforms 31, thereby resisting movement between the fan blade root and the root slot 13 formed in the rotor fan hub 11 substantially eliminating wear between these elements when the fan blades 10 are turned at low speeds. Accordingly, in the assembly of the fan blades on the rotor fan hub the blade root are easily inserted into the root slots and are later biased in tension by the insertion of the anti-fretting and platform inserts thus eliminating movement between the blade root in the root slot when the fan is turned by wind action with the engine off.

The fan blade anti-fretting insert actively contributes preventing wear between a root portion of a fan blade and a root slot of a rotor fan hub of a turbo fan engine. This can be accomplished by providing an insert member formed of composite spring material having a memory. The insert is positioned in the gap formed between the root portions of adjacent fan blades and abuts at an outer surface portion of the rotor fan hub in the gap and at an upper end thereof abuts a connection formed in opposed fan blades. The insert thus applies a pushing force against the connection engaged by the opposed wall portions to result in a pulling force on the root portion to prevent rocking of the root portion in the root slot at low rotational speeds of the rotor fan hub such as caused by wind milling of the fan blades. The insert member can be formed of spring steel material and can be forced in a gap to locate a bottom wall portion thereof in a radial groove formed in the outer surface portion of the root fan hub for retention of the insert member at a precise location in the gap.

The above description is meant to be exemplary only, and one skilled in the art will recognize that changes may be made to the embodiment described therein without departing from the scope of the invention disclosed. For instance, it is understood that the anti-fretting device could take various forms and is not limited to a pair of interconnected U-shaped legs. It is therefore within the ambit of present invention to cover any obvious modifications provided that these modifications fall within the scope of the appended claims.

What is claimed is:

1. A fan blade platform assembly comprising a rotor fan hub, a plurality of fan blades and a plurality of plate inserts, the plate inserts shaped and dimensioned to span a gap formed between platforms of adjacent fan blades of a turbo fan engine, the plates and platforms providing a gaspath surface, the plate inserts retainingly engaged under arresting shoulders of said adjacent fan blades by spring forces exerted by a plurality of spring inserts held captive and in contact between said plate inserts and an outer surface of the rotor fan hub, wherein each of said spring inserts comprises a U-shaped insert member formed of a spring material having a memory, said U-shaped insert member defining a bottom wall portion adapted to abut said outer surface of said rotor fan hub between said adjacent fan blades and having opposed side wall portions dimensioned to abut at an upper end thereof against an inner face of said plate inserts and to exert a pushing force thereon.

2. The fan blade platform assembly as claimed in claim 1, wherein said arresting shoulders are integrally formed in the platforms of the fan blades, the platforms of adjacent fan blades being spaced from one another along all the extent thereof by said plate inserts.

3. The fan blade platform assembly as claimed in claim 1, wherein the platforms of the fan blades are provided in the form of lip formations extending outwardly from opposed sides of the fan blades, said lip formations having a flat underface shaped to receive opposed edge face portions of said plate inserts.

4. The fan blade platform assembly as claimed in claim 1, wherein each of said plate inserts is a thin titanium plate having an arcuate profile.

5. The fan blade platform arrangement as claimed in claim 1, wherein each of said plate inserts is a thin plate formed of the same material as said fan blades.

* * * * *